US007236569B2

(12) United States Patent
Takeuchi et al.

(10) Patent No.: US 7,236,569 B2
(45) Date of Patent: Jun. 26, 2007

(54) X-RAY TUBE

(75) Inventors: Ryozo Takeuchi, Hitachi (JP); Yoshiaki Tsumuraya, Mobara (JP)

(73) Assignee: Hitachi, Ltd., Tokyo (JP)

( * ) Notice: Subject to any disclaimer, the term of this patent is extended or adjusted under 35 U.S.C. 154(b) by 25 days.

(21) Appl. No.: 11/171,375

(22) Filed: Jul. 1, 2005

(65) Prior Publication Data

US 2006/0002516 A1 Jan. 5, 2006

(30) Foreign Application Priority Data

Jul. 5, 2004 (JP) ..... 2004-198299

(51) Int. Cl.
*H01J 35/02* (2006.01)

(52) U.S. Cl. ..... 378/139; 378/136

(58) Field of Classification Search ..... 378/119, 378/121, 122, 123, 130, 139
See application file for complete search history.

(56) References Cited

U.S. PATENT DOCUMENTS 4,943,989 A * 7/1990 Lounsberry et al. ..... 378/130
6,570,960 B1 * 5/2003 Kuzniar et al. ..... 378/125
6,819,741 B2 * 11/2004 Chidester ..... 378/136

FOREIGN PATENT DOCUMENTS

JP 2001-319607 11/2001

OTHER PUBLICATIONS

O. Yamamoto, T. Hara, H. Matsuura and M. Hayashi, "Temporal Behavior of Surface Charge Accumulation in Bridged Vaccum Gaps", Transactions on Dielectrics and Electrical Insulation, vol. 2, No. 2, Apr. 1995, Department of Electrical Engineering, Kyoto University, Kyoto, Japan.

I.D. Chalmers, J.H. Lei, B. Yang and W.H. Siew, "Surface Charging and Flashover on Insulators in Vacuum", Transactions on Dielectrics and Electrical Insulation, vol. 2 No. 2, Apr. 1995, Department of Electronic and Electrical Engineering, University of Strathclyde, Glassgow, UK.

* cited by examiner

*Primary Examiner*—Edward J. Glick
*Assistant Examiner*—June Yun
(74) *Attorney, Agent, or Firm*—Antonelli, Terry, Stout & Kraus, LLP.

(57) ABSTRACT

The invention improves an insulating performance of an X-ray tube without increasing an insulation size. An X-ray tube in accordance with the invention keeps a mechanical strength of a glass insulation material and improves an insulation withstand voltage by a concavity and convexity, by forming a concavity and convexity having an arithmetic mean surface roughness of JIS B0601-1994 equal to or more than 1.0 μm and equal to or less than 10 μm in a vacuum side surface of a glass insulation material supporting electric conductors within a vacuum chamber for a range equal to or more than 2 mm from a position in an end of the electric conductors.

7 Claims, 5 Drawing Sheets

X-RAY TUBE

TECHNICAL FIELD

The present invention relates to an x-ray tube used in an X-ray diagnostic apparatus or the like, and more particularly to a technique for improving a withstand voltage of a glass insulation material supporting a high-voltage electric conductor such as a cathode or the like.

BACKGROUND ART

The X-ray tube is, for example, structured, as described in patent document 1 (JP-A-2001-319607), such that a cathode supplying an electron and an anode irradiating the electron so as to generate an X-ray are received within a glass vessel formed by a glass, an inner side of the glass vessel is formed in a vacuum condition, the cathode and the anode or the cathode and a ground potential conductor are insulated by the vacuum and the glass, and an outer side of the glass vessel is filled with an insulating fluid.

In the X-ray tube having the structure mentioned above, a weak position in view of an insulation is an interface between the glass and the vacuum. It has been known that an insulating performance is significantly lowered in the case that a gas component is adsorbed to a vacuum side interface of the glass, or that a conductive dust is attached. In this case, in conventional, there has been applied a conditioning process of mirror finishing an inner surface of the glass vessel, sufficiently cleaning by means of a solvent or the like and thereafter applying a voltage having a limited current via a high resistance while exhausting the inner side of the glass vessel so as to gradually improve a withstand voltage performance. The withstand voltage performance of the vacuum portion and the inner surface of the glass vessel is regulated to a necessary state in accordance with these processes, and the insulation of the X-ray tube is secured by charging the insulating fluid in the outer side of the glass vessel.

On the other hand, although it is not a technique relating to the X-ray tube, there has been reported a matter that a creepage flashover voltage of a glass spacer supporting a high-voltage conductor can be improved by polishing a surface of the glass spacer and forming a concavityand convexity having an average surface roughness between 0.003 and 3.07 μm, in order to improve the insulating performance of the glass insulation material within the vacuum container (non-patent document 1 ("Flashover Characteristics Of A Glass Spacer In Vacuum" Institute of Electrical Engineers National Convention in 2003, in Sendai on 2003 Mar. 17 to 19, First Edition 1-076, page 102)).

SUMMARY OF THE INVENTION

However, there is rarely an X-ray tube in which an insulating performance is lowered even if the conditioning process as mentioned above is applied. Accordingly, a stable and further improvement of an insulation withstand voltage is desired.

Further, the technique described in the non-patent document 1 relates to a test data about a sample of a cylindrical comparatively small glass spacer having a diameter of 54 mm and a thickness of 0.3 mm to 10 mm, and does not take into consideration a problem in a mechanical strength or the like in the case of being applied to the X-ray tube.

An object of the present invention is to improve an insulating performance of an X-ray tube without increasing an insulation size.

In order to achieve the problem mentioned above, in accordance with the present invention, there is provided an X-ray tube wherein a concavity and convexity having an arithmetic mean surface roughness equal to or less than 10 μm is formed in a vacuum side surface of a glass insulation material supporting an electric conductor within a vacuum chamber for a fixed range from a position in an end of the electric conductor.

In accordance with the present invention, it is experimentally confirmed that an insulation performance of an inner surface of a glass insulation material such as a glass vessel or the like can be improved. Further, the concavity and convexity is limited to the fixed range from the end of the electric conductor on the basis of holding a mechanical strength of the glass insulation material, and a knowledge that the insulation performance is not improved as shown in experimental data in FIG. 4 even if the concavity and convexity is formed for a range equal to or more than necessity. In particular, in accordance with the present invention, an effect of improving the insulation performance is stable, and it is possible to dissolve an unstable insulating performance such as the prior art.

In this case, the arithmetic mean surface roughness of the concavity and convexity is defined in Japanese Industrial Standards (JIS) B0601-1994. An upper limit of the arithmetic mean surface roughness of the concavity and convexity is set to 10 μm for the purpose of inhibiting the mechanical strength of the glass insulation material from being lowered. Further, if a lower limit is 1.0 μm, it is possible to achieve an improvement of the insulation withstand voltage by the concavity and convexity.

Further, it is preferable that the fixed range forming the concavity and convexity is set to at least a range of 2 mm. However, even if the range forming the concavity and convexity is equal to or more than 2 mm, the effect of improving the withstand voltage property does not change so much (refer to FIG. 4). Accordingly, it is preferable to determine the range forming the concavity and convexity while taking the mechanical strength into consideration.

In particular, it is desirable to form the concavity and convexity in accordance with the present invention in a vacuum side surface of the glass insulation material supporting the cathode or the electric conductor having the same electric potential as the cathode. Accordingly, it is possible to effectively improve the insulation performance by inhibiting an initial motion of the electron emitted to the surface of the glass insulation material from the cathode. However, the present invention is not limited to this, but the concavity and convexity mentioned above can be formed for the fixed range from the end of the electric conductor having the ground electric potential opposing to the electric conductor having the same electric potential as that of the cathode via the glass insulation material.

Further, the concavity and convexity in accordance with the present invention can be formed in accordance with a sandblast method by using any one of an alumina, a high purity alumina and a zirconia having an average particle diameter between 8 μm and 100 μm.

EFFECT OF THE INVENTION

In accordance with the present invention, it is possible to improve the insulation performance of the X-ray tube without increasing the insulation size.

Other objects, features and advantages of the invention will become apparent from the following description of the embodiments of the invention taken in conjunction with the accompanying drawings.

DESCRIPTION OF THE PREFERRED EMBODIMENTS

A description will be given of the present invention on the basis of embodiments.

(Embodiment 1)

Figure 1:
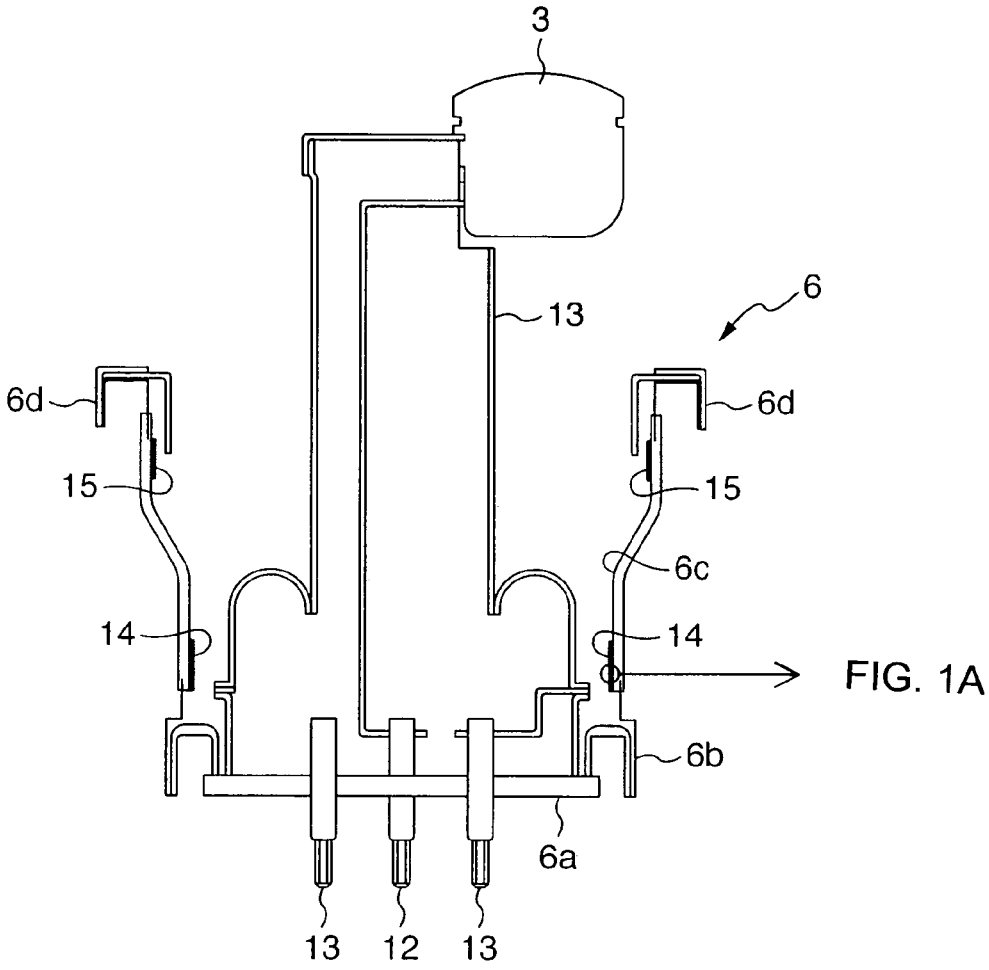
FIG. 1 is a schematic view of a main portion of an embodiment of an X-ray tube in accordance with the present invention.
Figure 2:
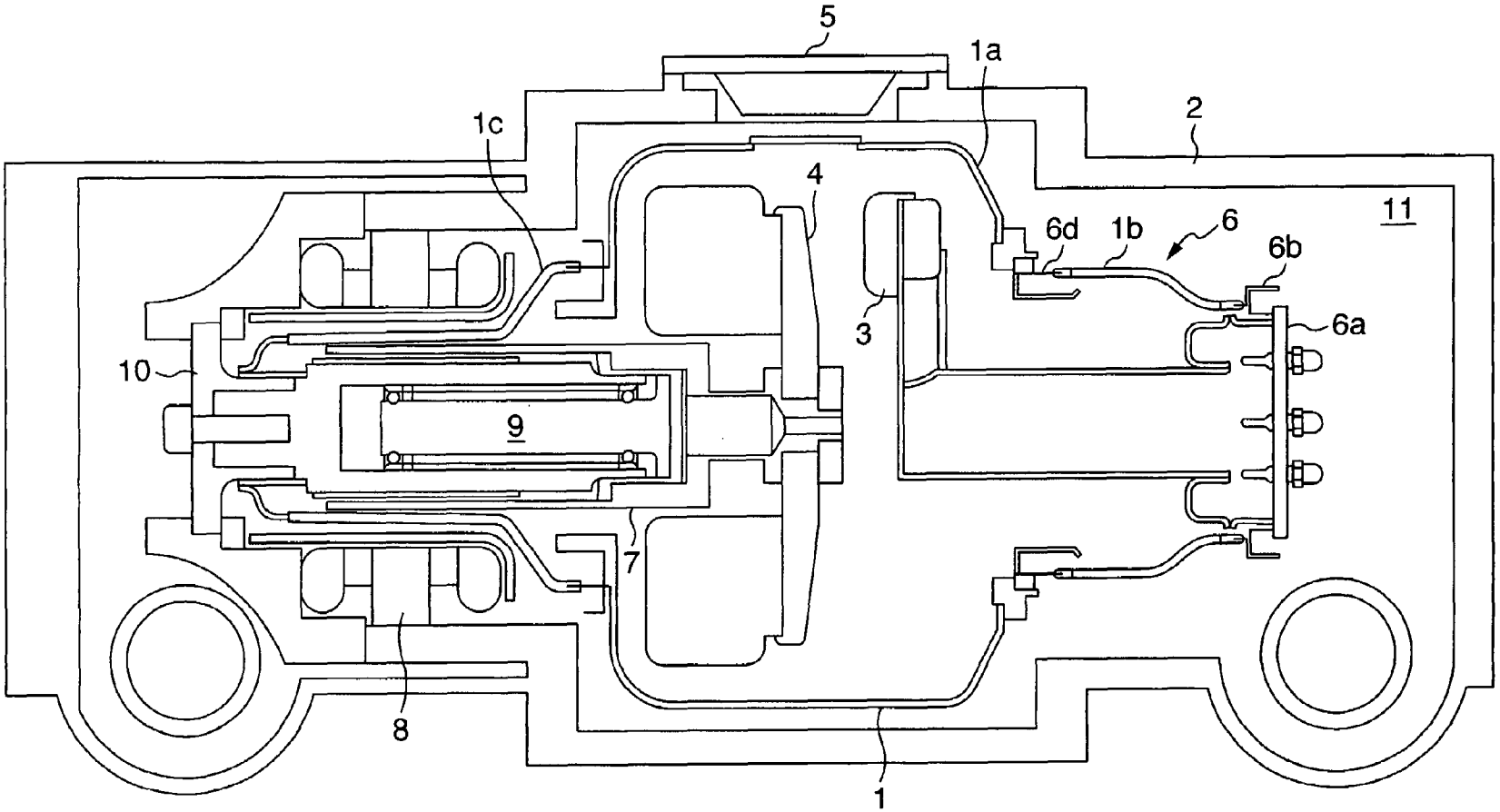
FIG. 2 is a schematic view of an entire of the embodiment of the X-ray tube in accordance with the present invention.

FIG. 1 shows an enlarged cross sectional view of a cathode stem portion of an X-ray tube in accordance with an embodiment to which the present invention is applied, and FIG. 2 shows a schematic view of an entire cross section of a general X-ray tube.

As shown in FIG. 2, the X-ray tube has a glass vessel 1 held in a vacuum condition, and a case 2 formed so as to surround the glass vessel 1, and an insulation fluid 11 is filled in a space between the glass vessel 1 and the case 2. The glass vessel 1 is formed by coupling a plurality of cylinder members having different diameters. Further, a cathode focused material 3 and a rotating disc-like anode target 4 are provided in an opposing manner in a large-diameter portion 1*a* in a center in a longitudinal direction of the glass vessel 1. A window 5 to which an X-ray is emitted is provided in a wall surface of the case 2 positioned in the opposing portion. The cathode focused material 3 is supported to a cathode stem portion 6 structuring one small-diameter portion 1*b* of the glass vessel 1. Further, the anode target 4 is supported to a rotor 7 provided in the other small-diameter portion 1*c* of the glass vessel 1, and the rotor 7 is provided so as to be rotatable around a bearing 9 by a stator coil 8 provided in an outer side of the glass vessel 1. The bearing 9 is supported to a metal stem 10 formed in an end portion of the glass vessel 1.

In this case, a description will be given of a structure of a cathode stem portion of an X-ray tube in accordance with the other embodiment relating to the feature portion of the present invention with reference to FIG. 1. The cathode stem portion 6 is formed by a disc-like ceramic stem 6*a* through which a main electrode 12 and a heater electrode 13 are inserted, and a tubular glass stem 6*c* firmly fixed via a metal electric conductor 6*b* firmly fixed to an outer periphery of the stem 6*a*. The stem 6 is formed, for example, by a borosilicate glass. The other end of the stem 6*c* is coupled to the large-diameter portion 1*a* in the center of the glass vessel 1 via a metal electric conductor 6*d*. A cylindrical cathode holder 13 is provided in an inner side of the stem 6*c* so as to rise from the step 6*a*, and the cathode focused material 3 is attached to a leading end of the cathode holder 13. The focused material 3 is connected to the main electrode 12, and is heated by an electric current supplied from the heater electrode 13.

A description will be given of an operation of the present embodiment structured as mentioned above. The electron is emitted from the focused material 3 by heating the focused material 3 in the cathode. The electron emitted from the focused material 3 is accelerated by an electric field formed between the focused material 3 and the anode target 4, and is irradiated to the anode target 4. Accordingly, the X-ray generated from the anode target 4 is picked up from the window 5.

In the X-ray tube as mentioned above, an insulation performance of the cathode stem 6 for keeping the vacuum condition of the main portion from the insulation and supporting the cathode is important. In the X-ray tube in FIG. 1, an outer side of the cathode stem 6 is covered with the insulating fluid 11, and controls the dust or the like in the fluid, whereby it is possible to achieve a stable insulation performance. On the other hand, the cathode stem portion 6 is constituted by a plurality of members, however, the insulation is taken charge by a vacuum side inner surface of the glass stem 6*c* between the cathode side metal electric conductor 6*b* and the ground electric potential side metal electric conductor 6*d*.

Figure 1A:
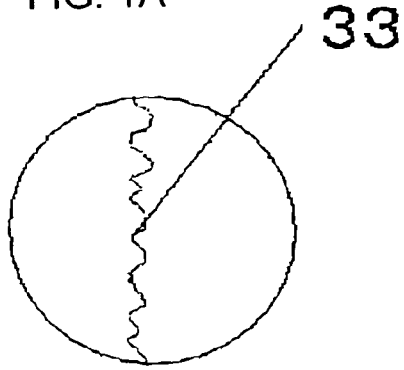
FIG. 1A is an enlarged view of a portion of the X-ray tube.

In particular, the present embodiment is characterized in that the concavity and convexity is formed for a fixed range 14 in the vacuum side inner surface of the glass stem 6*c* from an end of the metal conductor 6*b*, as illustrated in enlarged view in FIG. 1A. It is preferable that the concavity and convexity is constituted by a concavity and convexity 33 having an arithmetic mean surface roughness of 10 μm defined in Japanese Industrial Standards (JIS) B0601-1994, as illustrated in FIG. 1A. If the arithmetic mean surface roughness is more than 10 μm, the mechanical strength of the glass stem is lowered.

Further, in order to apply the concavity and convexity having some μm to the glass inner surface, it is possible to form the concavity and convexity in accordance with a sandblast method by using any one of an alumina, a high purity alumina and a zirconia having an average particle diameter between 8 μm and 100 μm. Further, in order to apply the concavity and convexity only to the fixed range 14, it is possible to achieve by apply a mask material such as a vinyl tape or the like to a portion except the fixed range 14 and applying the sandblast method.

Figure 3:
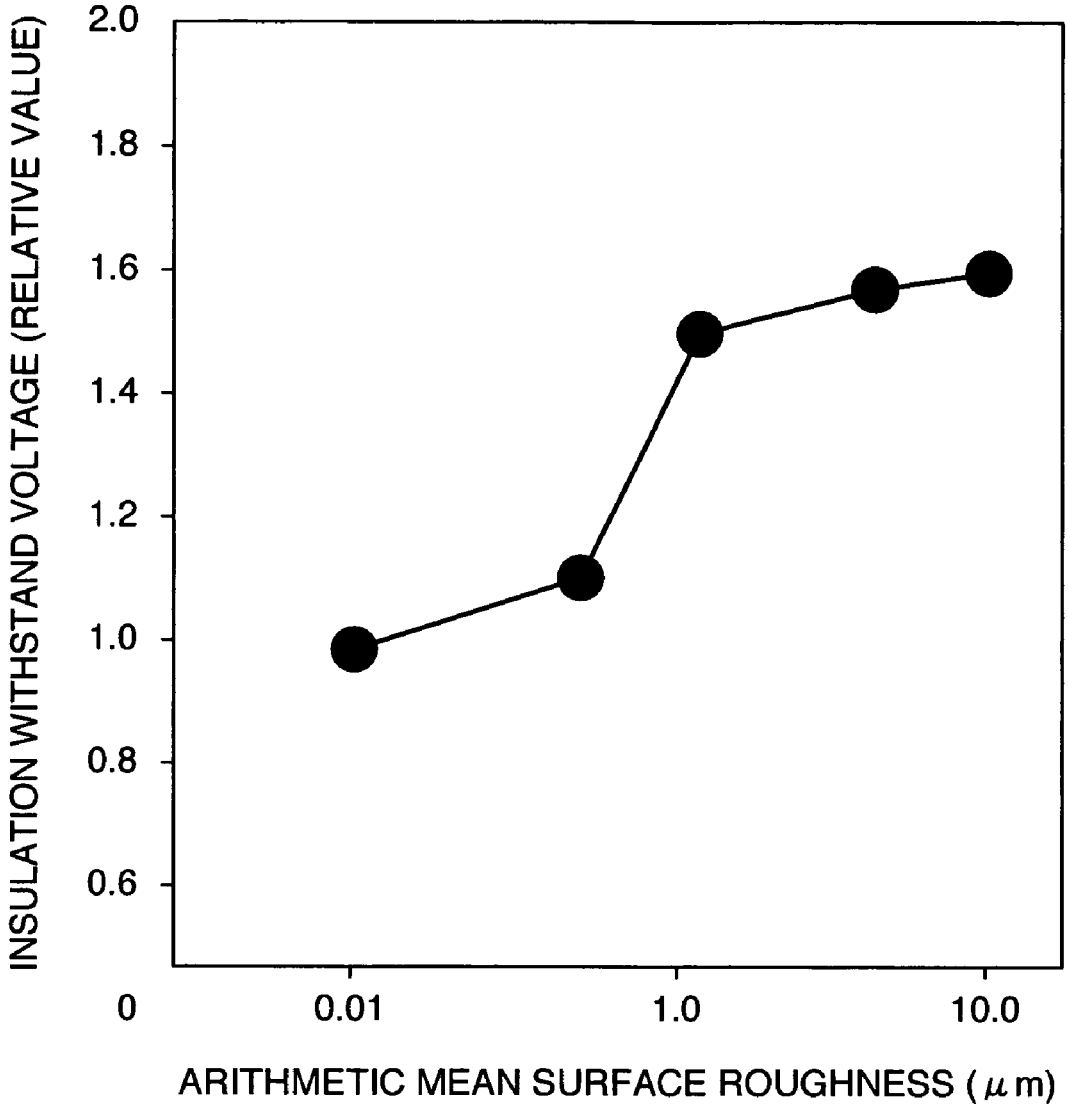
FIG. 3 is a graph of an experimental data showing a relation between a concavity and convexity provided in a surface of a glass insulation material of a cathode stem portion and an insulation withstand voltage.

FIG. 3 shows an experimental data showing a relation between a depth of the concavity and convexity applied to the glass inner surface and the insulation withstand voltage. A horizontal axis in FIG. 3 shows an arithmetic mean surface roughness (μm) defined in JIS mentioned above, and a vertical axis shows a relative value of the insulation withstand voltage in the case that the insulation withstand voltage having the arithmetic mean surface roughness of 0.01 μm is set to "1". As is apparent from FIG. 3, the insulation withstand voltage is exponentially improved in the case that the arithmetic mean surface roughness is equal to or more than 1.0 μm. It is known that the insulation withstand voltage in the case that the concavity and convexity having the arithmetic mean surface roughness equal to or more than 1.0 μm is provided is equal to or more than about 1.5 times of that having no concavity and convexity.

Figure 4:
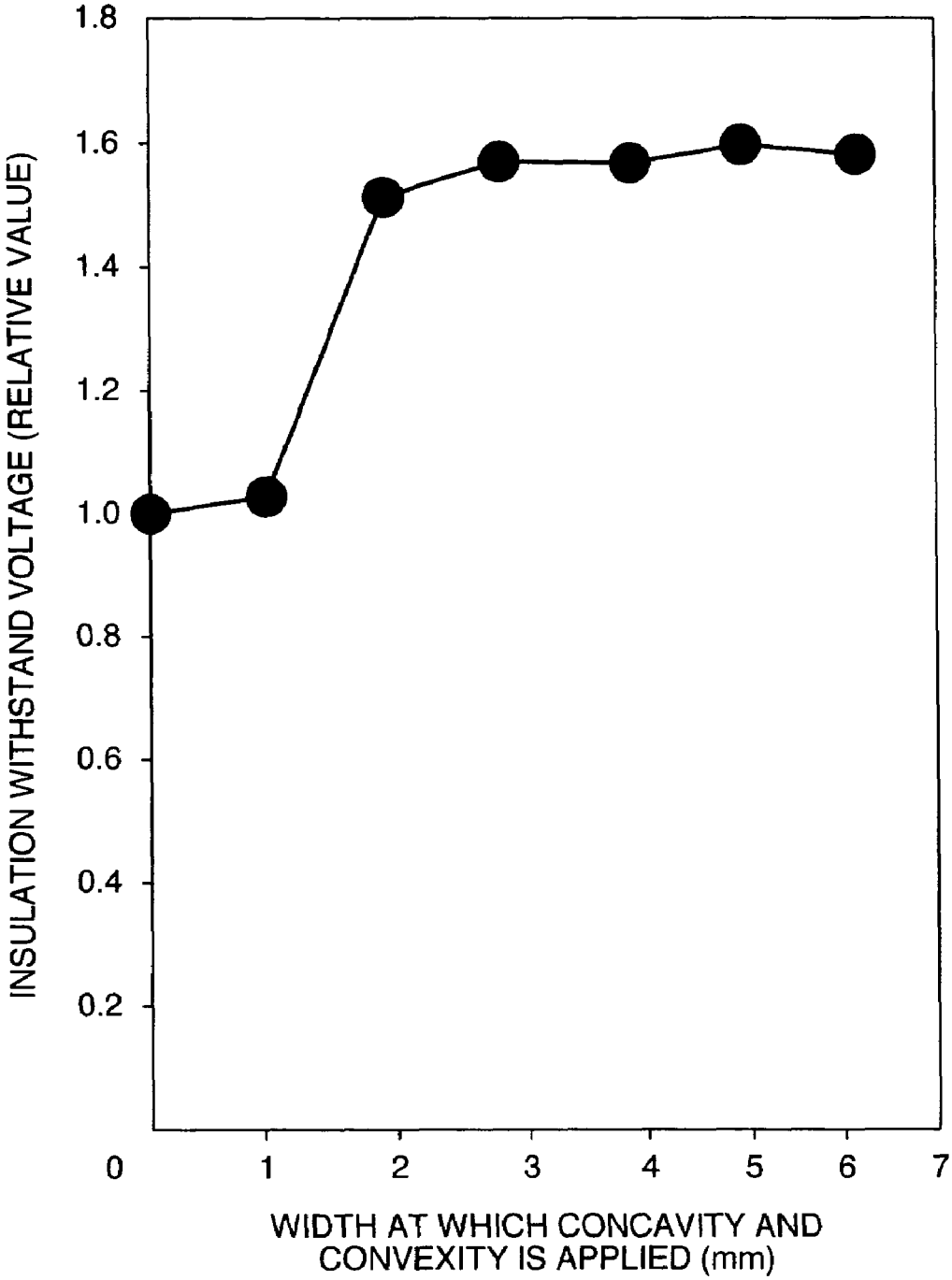
FIG. 4 is a graph of an experimental data showing a relation between a width of the concavity and convexity provided in the surface of the glass insulation material from an end of an electric conductor of the cathode stem portion and the insulation withstand voltage.

Next, FIG. 4 shows an experimental data about an effect of the fixed range 14 to which the concavity and convexity is applied. In FIG. 4, a horizontal axis shows a width (mm) at which the concavity and convexity is applied, and a vertical axis shows a relative value of the insulation withstand voltage in the case that the insulation withstand voltage having no concavity and convexity is set to "1". As is apparent from FIG. 4, it is possible to obtain the same effect as the case that the concavity and convexity is applied to an entire surface of the inner surface of the stem 6*c*, by forming the concavity and convexity in the inner surface of the glass stem 6*c* at a width of 2 mm from the end of the metal electric conductor 6*b* in the cathode side.

Putting the above matters in order, it is possible to widely improve the insulation withstand voltage without generating the reduction in the mechanical strength of the glass insulation material, by providing with the concavity and convexity having the arithmetic mean surface roughness equal to or more than 1.0 μm and equal to or less than 10 μm defined in Japanese Industrial Standards (JIS) B0601-1994 in the range of at least 2 mm from the position of the end of the metal electric conductor supported by the glass insulation material, while keeping the mechanical strength of the stem corresponding to the glass insulation material and taking the effect of the concavity and convexity into consideration. As a result, it is possible to significantly extend a service life of the X-ray tube.

Further, in the embodiment mentioned above, there is shown the embodiment in which the concavity and convexity is provided in the fixed range 14 from the end of the metal electric conductor 6*b* in the cathode side of the glass stem 6*c*. This is because the insulation performance can be effectively improved by inhibiting the initial motion of the electron emitted to the surface of the stem 6*c* corresponding to the glass insulation material from the cathode. However, the structure is not limited to this, and the concavity and convexity can be provided in a fixed range 15 from the end of the metal electric conductor 6*d* in the ground side. Further, the concavity and convexity can be provided in an entire range from two metal electric conductors 6*b* to 6*d* supported by the glass stem 6*c* as far as having no trouble with the mechanical strength.

(Embodiment 2)

Figure 5:
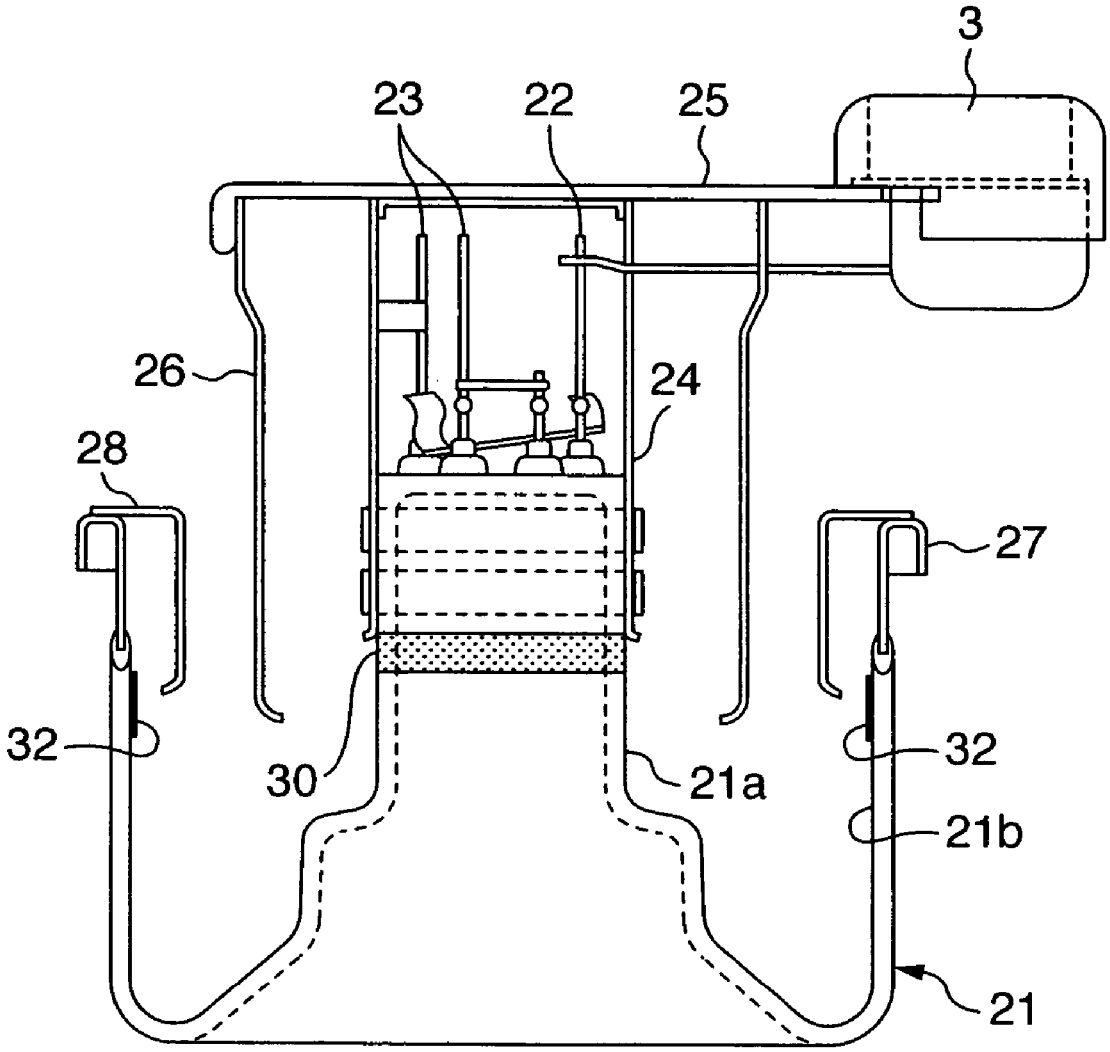
FIG. 5 is a schematic view of a main portion of the other embodiment of the X-ray tube in accordance with the present invention.

A description will be given of a structure of a cathode stem portion of an X-ray tube in accordance with the other embodiment relating to the feature portion of the present invention with reference to FIG. 5. A structure of the cathode stem portion in FIG. 5 is slightly different from FIG. 1, that is, an entire of a cathode stem portion 21 is formed in a glass insulation material. In other words, the cathode stem portion 21 is structured such as to be provided with a hollow cylindrical center stem 21*a* supporting a main electrode 22 and a heater electrode 23. The center stem 21*a* is structured such as to have an outer tube stem 21*b* by expanding a lower end portion and bending from a lower end, thereby being risen so as to surround the center stem 21*a*, such as a hanging bell. The cathode stem portion 21 including the center stem 21*a* and the outer tube stem 21*b* is formed, for example, by a borosilicate glass.

A metal electric conductor 24 supporting the cathode is fixed to an upper end portion of the center stem 21*a*, and a metal electric conductor 25 is fixed orthogonal to an upper end of the metal electric conductor 24. The cathode focused material 3 is attached to one leading end portion of the metal electric conductor 25, and the focused material 3 is connected to the main electrode 22. Further, a shield ring 26 constituted by a tubular electric conductor is concentrically provided in the middle of the center stem 21*a* so as to be supported to the metal electric conductor 25, thereby reducing the electric field. Further, a ring-shaped metal electric conductor 27 connected to the ground electric potential is firmly fixed to a leading end portion of the outer tube stem 21*b*, and a shield ring 28 constituted by a tubular electric conductor is concentrically provided with the shield ring 26 in a leading end of the metal electric conductor 27, thereby reducing the electric field.

In particular, in accordance with the present embodiment, the concavity and convexity is formed for a fixed range 30 shown by a half-tone dot meshing, in an inner surface in a vacuum side of the center stem 21*a* from an end of the metal electric conductor 24. The fixed range 30 is the same as the first embodiment. Further, an arithmetic mean surface roughness of the concavity and the convexity is the same as the first embodiment.

In accordance with the present embodiment, it is possible to achieve the same effects as those of the embodiment in FIG. 1. Further, the concavity and convexity may be formed for a fixed range 32, in the inner surface in the vacuum side of the outer tube stem 21*b* from an end of the metal electric conductor 27 in the ground electric potential side, or the concavity and convexity may be formed in an entire range from the center stem 21*a* to the outer tube stem 21*b*.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An X-ray tube comprising:

a cathode emitting an electron;

an anode emitting an X-ray in response to irradiation by the electron emitted from said cathode; and the cathode and the anode being received in a vacuum container, wherein a vacuum side surface of a glass insulation material supporting at least one electric conductor within said vacuum chamber has a concavity and convexity having an arithmetic mean surface roughness equal to or less than 10 μm for at least a fixed length from a position in an end of said at least one electric conductor.

2. An X-ray tube as claimed in claim 1, wherein said at least a fixed length is set to at least 2 mm.

3. An X-ray tube as claimed in claim 2, wherein said at least one electric conductor is constituted by an electric conductor having the same electric potential as that of said cathode.

4. An X-ray tube as claimed in claim 2, wherein said at least one electric conductor includes another electric conductor which is constituted by an electric conductor having a ground electric potential opposing to the electric conductor having the same electric potential as that of said cathode via said glass insulation material.

5. An X-ray tube as claimed in claim 1, wherein said concavity and convexity is constituted by a concavity and convexity having an arithmetic mean surface roughness equal to or more than 1.0 μm and equal to or less than 10 μm.

6. An X-ray tube as claimed in claim 1, wherein said concavity and convexity is formed in accordance with a sandblast method by using any one of an alumina, a high purity alumina and a zirconia having an average particle diameter between 8 μm and 100 μm as sandblast material.

7. An X-ray tube as claimed in claim 1, wherein said glass insulation material is constituted by a borosilicate glass.

* * * * *